US006503871B2

(12) United States Patent
Martin

(10) Patent No.: US 6,503,871 B2
(45) Date of Patent: Jan. 7, 2003

(54) POWER STEERING FLUID ADDITIVE

(75) Inventor: Jon W. Martin, Loudon, TN (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/826,093

(22) Filed: Apr. 4, 2001

(65) Prior Publication Data

US 2002/0144853 A1 Oct. 10, 2002

(51) Int. Cl.[7] ..... C10M 133/06; B62D 5/06

(52) U.S. Cl. ..... 508/364; 508/527; 508/563; 508/579; 252/77; 180/417

(58) Field of Search ..... 508/527, 364

(56) References Cited

U.S. PATENT DOCUMENTS

| | | | | | |
|---|---|---|---|---|---|
| 4,289,546 | A | | 9/1981 | Hacias | 148/246 |
| 4,289,547 | A | | 9/1981 | King et al. | 148/246 |
| 4,537,694 | A | * | 8/1985 | Horodysky | 508/527 |
| 4,552,569 | A | * | 11/1985 | Horodysky | 252/403 |
| 4,789,493 | A | * | 12/1988 | Horodysky | 508/554 |
| 4,795,583 | A | | 1/1989 | Papay | 252/77 |
| 4,808,196 | A | * | 2/1989 | Horodysky | 252/401 |
| 4,849,119 | A | * | 7/1989 | Horodysky | 508/527 |
| 5,174,914 | A | * | 12/1992 | Gutzmann | 508/527 |
| 5,178,482 | A | | 1/1993 | Wood | 403/130 |
| 5,219,480 | A | | 6/1993 | Gutierrez et al. | 508/292 |
| 5,836,417 | A | | 11/1998 | Martin | 508/539 |

OTHER PUBLICATIONS

DUOMEEN TDO product brochure, Pigment Dispersing Agent, Akzo Nobel Surface Chemistry, pp. 1–7.*

* cited by examiner

*Primary Examiner*—Ellen M. McAvoy
(74) *Attorney, Agent, or Firm*—Tarolli, Sundheim, Covell, Tummino & Szabo L.L.P.

(57) ABSTRACT

A fluid power steering gear (10) comprises a housing (16). A power steering fluid (34) is disposed within the housing (16). A seal (50) contains the power steering fluid (34) within said housing (16). A member (20) extends through the housing (16) and the seal (50). The member (20) is movable relative to the housing (16) and the seal (50) in response to a change in the fluid pressure in the housing (16). The power steering fluid (34) comprises a base oil and a metal-free lubricant additive. The metal-free lubricant additive is soluble in the base oil and modifies the interfacial surface tension between the base oil and the member (20) and the base oil and the seal (50). The weight percent of the metal-free lubricant additive is about 0.1% to about 5.0%, by weight of the power steering fluid (34).

18 Claims, 2 Drawing Sheets

POWER STEERING FLUID ADDITIVE

FIELD OF THE INVENTION

The present invention relates to a power steering fluid for a fluid power steering gear for a vehicle, and particularly to a power steering fluid additive for use in a power steering fluid.

BACKGROUND OF THE INVENTION

A fluid power rack and pinion vehicle steering gear commonly includes a rack that extends axially through a chamber. The rack is preferably made from a metal, such as steel. The ends of the rack project axially outward from the ends of the chamber. Steering linkage is connected to the projecting ends of the rack and to the steerable wheels of the vehicle.

A piston is fixed to the rack within the chamber. Rotation of the vehicle steering wheel actuates a valve that causes power steering fluid under pressure to act against the piston. The force exerted by the fluid moves the piston within the chamber and moves the rack axially. Axial movement of the rack moves the steering linkage to turn the steerable wheels of the vehicle. The ends of the chamber through which the rack projects are sealed with suitable seals to prevent fluid leakage from the chamber.

Axial movement of the metal rack creates friction between the seals and the metal rack. Friction between the seals and the metal rack causes the surfaces of the seals to stick and slip against the surface of the metal rack. The sticking and slipping of the seals cause the seals to vibrate at a frequency of about 100 to about 200 Hertz, which results in noise in the human hearing range.

Commercially available power steering fluids, when used in a power steering gear, provide lubrication between the seals and the metal rack. The amount of lubrication, however, is insufficient to eliminate noise generated by axial movement of the metal rack.

Commercially available power steering fluids include mineral oil similar to kerosene. Mineral oil is a poor lubricant and has a high viscosity at low temperatures. The pour point of a mineral oil is typically in the range of −25° C. Below about −25° C., mineral oil is semisolid and not useful to transmit hydraulic power. Wax is an excellent lubricant for rubber/steel interfaces and can be added to mineral oil. Wax, however, when added to mineral oil, increases the viscosity of the mineral oil making the mineral oil unsuitable for use as a power steering fluid.

SUMMARY OF THE INVENTION

The present invention is a fluid power steering gear. The fluid power steering gear comprises a housing. A power steering fluid is disposed within the housing. A seal contains the power steering fluid within the housing. A member extends through the housing and the seal. The member is movable relative to the housing and the seal in response to a change in the fluid pressure in the housing. The power steering fluid comprises a base oil and a metal-free lubricant additive. The metal-free lubricant additive is soluble in the base oil and modifies the interfacial surface tension between the base oil and the member and the base oil and the seal. The weight percent of the metal-free lubricant additive is about 0.1% to about 5.0%, by weight of the power steering fluid.

In accordance with one embodiment of the present invention the metal-free lubricant additive comprises a fatty acid salt of a secondary amine.

BRIEF DESCRIPTION OF THE DRAWINGS

Further features of the present invention will become apparent to those skilled in the art to which the present invention relates from reading the following description of the invention with reference to the accompanying drawings, in which.

DESCRIPTION OF A PREFERRED EMBODIMENT

Figure 1:
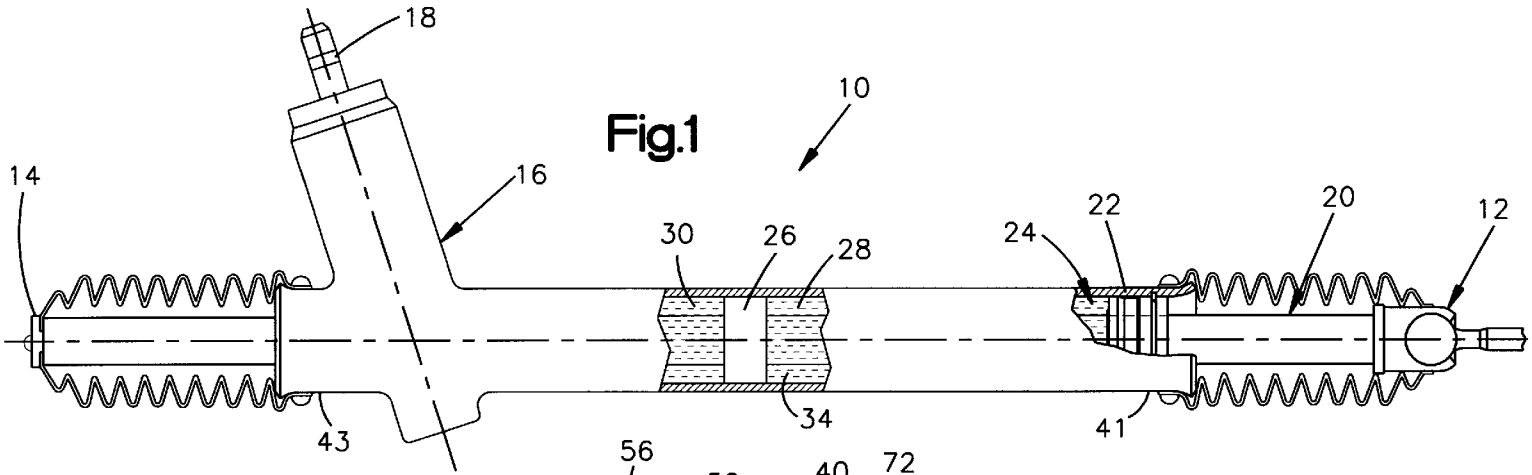
FIG. 1 is a schematic view of a power rack and pinion vehicle steering gear with parts cut away.

The present invention relates to a fluid power steering gear for a vehicle, and particularly to a power steering fluid for use in a fluid power steering gear. The present invention is applicable to various steering gear constructions. As representative of the present invention, FIG. 1 illustrates a fluid power rack and pinion vehicle steering gear 10. The steering gear 10 is connected with a pair of steerable vehicle wheels (not shown) in a known manner by a steering linkage 12 at one end of the steering gear 10 and by a steering linkage (not shown) at the opposite end 14 of the steering gear 10. The steering gear 10 is associated with a power steering pump (not shown) that when operating circulates power steering fluid through at least portions of the steering gear 10.

The steering gear 10 includes a housing 16, an input shaft 18, connected with a steering control valve (not shown) and with a pinion (not shown), and a rack 20. The rack 20 extends longitudinally through a tubular portion 22 of the housing 16. The rack 20 is made from 1040 carbon steel, available from LTV Steel Co., and the tubular portion 22 of the housing 16 is made from 1018 carbon steel.

The tubular housing portion 22 partially defines a fluid chamber 24. The fluid chamber 24 contains a power steering fluid 34.

A piston 26 is fixed to the rack 20 at an intermediate location. The piston 26 is located within the chamber 24. The piston 26 divides the chamber 24 into a first portion 28 and a second portion 30.

Upon rotation of a vehicle steering wheel (not shown), the input shaft 18 is rotated to actuate the steering control valve, and the pressure of the fluid 34 increases against the piston 26, causing the rack 20 to move axially within the housing 16. Axial movement of the rack 20 moves the steering linkage connected to the ends of the rack 20 thus turning the steerable wheels of the vehicle.

Figure 2:
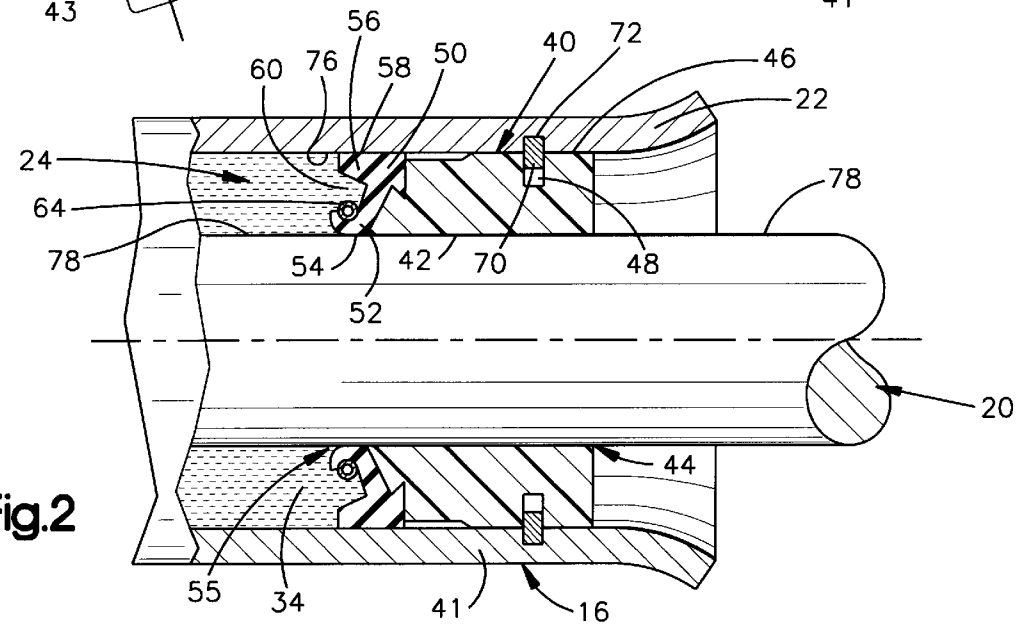
FIG. 2 is an enlarged view of a portion of FIG. 1 showing a rack bushing and a seal assembly in the steering gear of FIG. 1.

One or more annular bushings 40 (FIG. 2) support the rack 20 for axial movement within the tubular housing portion 22. The bushing 40 is positioned adjacent to end 41 of the tubular housing portion 22. A similar bushing is positioned at the opposite end 43 (FIG. 1) of the tubular housing portion 22. Each bushing 40 is preferably injection molded of a 45% glass reinforced polyester, such as RYNITE 545 polyester, which is commercially available from E.I. DuPont de Nemours & Co. The bushing 40 has a cylindrical inner surface 42 that defines a passage through the bushing 40. The bushing also has a cylindrical outer surface 46. A snap ring groove 48 is formed in the outer surface 46 of the bushing 40.

An annular seal member 50 is connected with the bushing 40. The seal member 50 includes an inner seal portion 52 having a radially inner seal surface 54. The inner seal surface 54 defines a seal opening 55. The seal member 50 further includes an outer seal portion 56 having a radially outer seal surface 58. An annular fluid receiving groove 60 is located between the inner seal portion 52 and the outer seal portion 56.

The seal member 50 is made from a rubber material. The rubber material can include a synthetic rubber, a natural rubber, or a combination thereof. Preferably the seal member is made from a synthetic rubber, such as VITON elastomer (trademark E.I. DuPont de Nemours & Co.), a hydrogenated nitrile elastomer or a conventional nitrile elastomer.

A circular garter spring 64 is located in the fluid receiving groove 60 of the seal member 50. The garter spring 64 engages a radially outward facing surface of the inner seal portion 52 of the seal member 50. The garter spring 64 presses the inner seal portion 52 of the seal member 50 radially inward against the rack 20.

A snap ring 70 is received in the groove 48 in the bushing 40 and in a groove 72 in the housing portion 22. The snap ring 70 retains the bushing 40 and the seal 50 in a set position in the housing portion 22. The snap ring 70 is a commercially available steel part of known construction.

In the assembled condition, the outer seal surface 58 of the seal member 50 sealingly engages an inner surface 76 of the housing portion 22. The inner seal surface 54 of the seal member 50 sealingly engages a cylindrical outer surface 78 of the rack 20. The garter spring 64 assists in pressing the inner seal surface 54 against the outer surface 78 of the rack 20. The fluid 34, under pressure in the chamber 24, urges the outer seal portion 56 radially outward and the inner seal portion radially inward to assist in sealing. Because of the sealing engagement between the seal member 50 and the tubular housing portion 22 on the one hand, and between the seal member 50 and the rack 20 on the other hand, the fluid 34 cannot flow axially through the passage 44 in the bushing 40 and through the seal opening 55 of the seal member 50. The seal member 50 and bushing 40 are merely examples of a rack support and seal member that may be used in the steering gear. Other structurally different rack supports and seal members could be used in the steering gear.

In accordance with the present invention, the power steering fluid 34 comprises a base oil. The base oil can be any base oil commonly used in a power steering fluid for a power steering gear. Examples of a base oil commonly used in a power steering fluid are a mineral oil, such as furfural-refined paraffinic oil, solvent-refined napthenic oil, or solvent refined aromatic oil, synthetic oil, such as hydrogenated or partially hydrogenated olefins, polyalkylene oxides, or blends thereof. A preferred base oil is a blend of polyalkylene oxides.

The power steering fluid also includes a metal-free lubricant additive. By "metal-free" it is meant that the lubricant additive is essentially free of metal atoms.

The metal-free lubricant additive of the present invention comprises a fatty acid salt of a secondary amine that is soluble in the base oil and that modifies the interfacial surface tension between the base oil and the rack 20 and the base oil and the seal member 50. The metal-free lubricant additive modifies the interfacial surface tension between the base oil and the rack 20 and the base oil and the seal member by reducing the interfacial surface tension between the base oil and the rack 20 and the base oil and the base oil and the seal member 50.

By "fatty acid", it is meant a carboxylic acid composed of a chain of alkyl groups containing 4 to 22 carbons atoms and characterized by a terminal carboxyl group (—COOH). The fatty acid of the present invention may be saturated or unsaturated. Preferably the fatty acid is an oleic acid.

Preferably, the secondary amine includes a long chain aliphatic group containing at least about 10 carbons. The long chain aliphatic group improves the solubility of the metal-free lubricant additive in the base oil. A preferred secondary amine is N-tallowalkyl-1,3-propane diamine.

A preferred fatty acid salt of a secondary amine is N-(tallowalkyl)-1,3-propanediamine dioleate. N(tallowalkyl)-1,3-propanediamine dioleate is commercially available from Akzo Nobel Chemicals Inc. of Chicago, Ill. under the trade name DUOMEEN TDO. DUOMEEN TDO consists of by weight about 98% to about 100% N-(tallowalkyl)-1,3-propanediamine dioleate, 0 to about 2% N-(tallowalkyl)-1,3-propanediamine, and 0 to about 2% 9-octadecanoic acid.

The amount of metal-free lubricant additive in the power steering fluid of the present invention is at least about 0.1%, by weight of the power steering fluid. It has been found that when the power steering fluid includes at least about 0.1%, by weight of the power steering fluid, of the metal-free lubricant additive, the friction created during movement of the rack 20 through the seal opening 55 is such that the seal member 50 does not vibrate and produce noise in the human hearing range.

It is believed that when the power steering fluid 34 includes less than about 0.1%, by weight of the power steering fluid, of the metal-free lubricant additive, the surface tension between the power steering fluid 34 and the rack 20 and the power steering fluid 34 and the seal member 50 is too high for the power steering fluid 34 to effectively wet the interface between the seal member 50 and the rack 20. Because the interface between the seal member 50 and the rack 20 is not effectively wetted with the power steering fluid 34, there is insufficient lubrication to minimize the friction created during movement of the rack 20 through the seal opening. The friction created by movement of the rack 20 through the seal opening 55 causes the seal member 50 to vibrate and produce noise in the human hearing range.

When at least about 0.1% by weight, based on the weight of the power steering fluid, of the metal-free lubricant additive is included in the power steering fluid 34, the surface tension between the power steering fluid 34 and the seal member 50 and the power steering fluid 34 and the rack 20 is reduced so that the power steering fluid 34 can effectively wet the interface between the seal member 50 and the rack 20. Wetting the interface between the seal member 50 and the rack 20 with power steering fluid 34 lubricates the interface and reduces the friction created during movement of rack 20 through the seal opening 54. This reduction in friction is sufficient to prevent the seal member 50 from vibrating at a frequency effective to produce noise within the human hearing range.

Preferably, the amount of metal-free lubricant additive in the power steering fluid is about 0.1% to about 5% by weight of the power steering fluid. A power steering fluid that includes an amount of metal-free lubricant additive greater than about 5%, by weight of the power steering fluid, does not have a viscosity at temperatures below 0° C. effective to provide fluid power for a power steering rack. More preferably, the amount of metal-free lubricant additive in the power steering fluid of the present invention is about 0.5% to about 1.0%, by weight of the power steering fluid.

The power steering fluid of the present invention can also include other additives commonly added to power steering fluids that improve the performance of the power steering fluid. A preferred additive is an antioxidant that retards oxidation, deterioration, and thermal degradation of the power steering fluid. Examples of antioxidants that can be used in the power steering fluid of the present invention are VANLUBE AZ, VANLUBE NA, and mixtures thereof. VANLUBE AZ is a zinc diamyldithiocarbamate, and VANLUBE NA is an alkylated diphenylamine. Both VANLUBE AZ and VANLUBE NA are commercially available from Vanderbilt Inc. of Norwalk, Conn. The total amount of antioxidant included in the power steering fluid of the present invention is less than about 2%, by weight of the power steering fluid. Preferably, the total amount of antioxidant in the power steering fluid is about 1.2% by weight of the power steering fluid.

Examples of other additives common to a power steering fluid to improve the performance of the power steering fluid are dispersants, corrosion inhibitors, antiwear agents, pour point dedressants, foam inhibitors, viscosity index improvers, and red dye. Preferably, the total amount of these other additives in the power steering fluid is less than about 10% by weight of the power steering fluid.

EXAMPLE 1

A power steering fluid was prepared consisting of, by weight of the power steering fluid, 98.55% of a base oil, 0.6% of a first antioxidant, 0.6% of a second antioxidant, and 0.25% of a metal-free lubricant additive. The base oil was a blend of polyalkylene oxides (PAO) commercially available from Royal Lubricants under the tradename RTK-11. The first antioxidant was a zinc diamyldithiocarbamate commercially available from Vanderbuilt Inc. under the trade name VANLUBE AZ. The second antioxidant was an alkylated diphenylamine commercially available Vanderbuilt Inc. under the trade name VANLUBE NA. The metal-free lubricant additive was a surfactant commercially available from Akzo Nobel Chemicals Inc. of Chicago, Ill. under the trade name DUOMEEN TDO. DUOMEEN TDO consists of, by weight, about 98% to about 100% N-(Tallowalkyl)-1,3-propanediamine dioleate, 0 to about 2% N-(Tallowalkyl)-1,3-propanediamine, and 0 to about 2% 9-octadecanoic acid.

The power steering fluid of Example 1 had a decomposition temperature, as determined by a differential scanning calorimeter, of about 228° C. A temperature of about 228° C. is well above the maximum operating temperature of 175° C. to which the power steering fluid could be exposed. The 40° C. oil viscosity of the power steering fluid of Example 1 was determined to be only about 0.9 centistoke greater than the 40° C. oil viscosity of the base oil (i.e., RTK-11 without any metal-free lubricant additive).

The power steering fluid of Example 1 was tested in a test apparatus similar to the steering gear of FIG. 1. The apparatus comprised a cylinder, a 23 mm diameter metal shaft that is reciprocal within the cylinder, and two rubber production seals at the ends of the cylinder through which the shaft projected. The apparatus was coupled to an Instron Tensile Testing Machine Model No. 1122, manufactured by the Instron Engineering Corporation of Canton, Mass.

The resistance force (i.e., drag) was measured for the power steering fluid of Example 1 at different pressures within the cylinder in the range of zero psig to 1,000 psig. The resistance force was also measured without using a power steering fluid within the cylinder at different pressures within the apparatus cylinder in the range of zero psig to 1,000 psig. The pressure in the cylinder that did not contain a power steering fluid was maintained by pumping nitrogen gas into the cylinder. The results are provided in FIG. 3.

Figure 3:
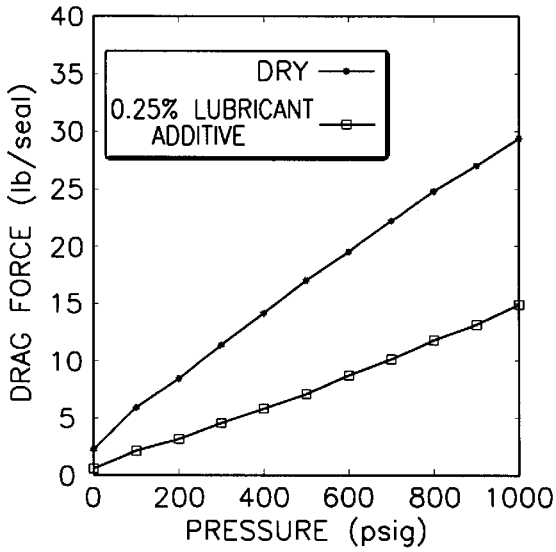
FIG. 3 is a graph showing the drag that exists between the rack and the rack seal of the assembly of FIG. 2 at different pressures. The graph compares the drag measured when power steering fluid prepared in accordance with one embodiment of the present invention is used to the drag measured when no power steering fluid is used.

As can be seen in FIG. 3, the resistance force measured using the power steering fluid of Example 1 in the cylinder was consistently about 50% less than that measured when no power steering fluid was used in the cylinder. For example, at 600 psig, the resistance force measured when no power steering fluid was used in the cylinder was about 20 lbs per seal. By comparison, at 600 psig, the resistance force measured when the power steering fluid of Example 1 was used in the cylinder was less than about 10 lbs per seal.

EXAMPLE 2

A power steering fluid similar to Example 1 was prepared. The power steering fluid consisted of, by weight of the power steering fluid, 97.8% of a base oil, 0.6% of a first antioxidant, 0.6% of a second antioxidant, and 1% of a metal-free lubricant additive. The base oil was RTK-11, the first antioxidant was VANLUBE AZ, the second antioxidant was VANLUBE NA, and the metal-free lubricant additive was DUOMEEN TDO.

The 40° C. oil viscosity of the power steering fluid of Example 2 was determined to be only about 1.0 centistoke greater than 40° C. oil viscosity of the base oil (i.e., RTK-11 without any metal-free lubricant additive).

The power steering fluid of Example 2 was tested in a steering gear test apparatus similar to the steering gear test apparatus used for testing Example 1. The resistance force was measured for the power steering fluid of Example 2 at different pressures within the cylinder in the range of zero psig to 1,000 psig. The resistance force was also measured without using a power steering fluid within the cylinder at different pressures within the apparatus cylinder in the range of zero psig to 1,000 psig. The pressure in the cylinder that did not contain the power steering fluid was maintained by pumping nitrogen gas into the apparatus. The results are provided in FIG. 4.

Figure 4:
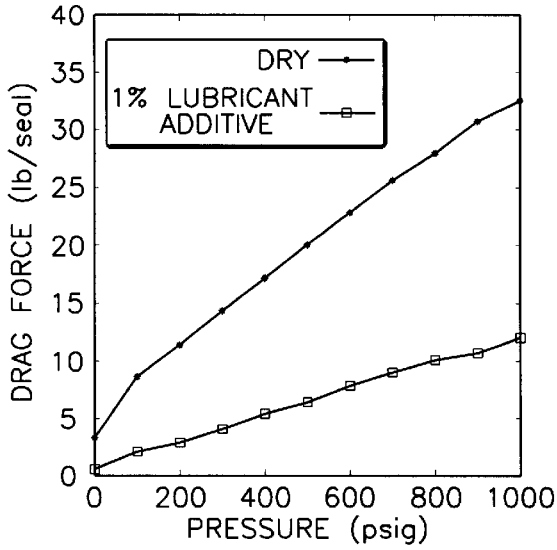
FIG. 4 is a graph showing the drag that exists between the rack and the rack seal of the assembly of FIG. 2 at different pressures. The graph compares the drag measured when power steering fluid prepared in accordance with a second embodiment of the present invention is used to the drag measured when no power steering fluid is used.

As can be seen in FIG. 4, the resistance force measured using the power steering fluid of Example 2 in the cylinder was about 50% to about 65% less than that measured when no power steering fluid was used in the cylinder. For example, at 600 psig, the resistance force measured when no power steering fluid was used in the cylinder was about 22.5 lbs per seal. By comparison, at 600 psig, the resistance force measured when the power steering fluid of Example 2 was used in the cylinder was less than about 7.5 lbs per seal.

COMPARATIVE EXAMPLE

A commercially available power steering fluid was tested in a steering gear test apparatus similar to the steering gear test apparatus for Examples 1 and 2. The resistance force was measured for the commercially available power steering fluid at different pressures within the cylinder in the range of zero psig to 1,000 psig. The resistance force was also measured without using a power steering fluid within the cylinder at different pressures within the cylinder in the range of zero psig to 1,000 psig. The pressure in the cylinder that did not contain the commercially available power steering fluid was maintained by pumping nitrogen gas into the cylinder. The results are provided in FIG. 5.

Figure 5:
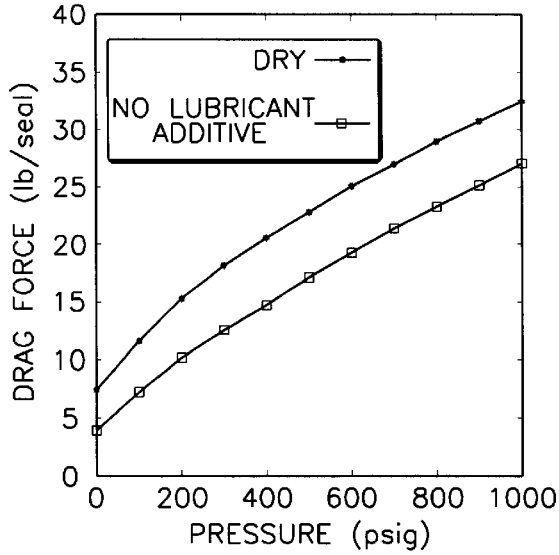
FIG. 5 is a comparison graph showing the drag that exists between the rack and the rack seal of the assembly of FIG. 2 at different pressures. The graph compares the drag measured when a commercially available power steering fluid is used to the drag measured when no power steering fluid is used.

As can be seen in FIG. 5, the resistance force measured using the commercially available power steering fluid in the cylinder was about 25% less than that measured when no power steering fluid was used in the cylinder. For example, at 600 psig, the resistance force measured when no power steering fluid was used in the cylinder was about 25 lbs pounds per seal. By comparison, at 600 psig, the resistance force measured when the commercially available power steering fluid was used in the cylinder was about 19 lbs per seal.

Advantages of the present invention should now be apparent. The power steering fluid of the present invention compared to commercially available power steering fluids minimized the friction produced when the metal rack moved through the seal opening in the seal member so that the seal member did not vibrate and produce a noise in the human hearing range. The power steering fluid of the present invention also reduced the drag measured by the power steering gear at least about 25% more than commercially available power steering fluids. Moreover the power steering fluid of the present invention had an a 40° C. oil viscosity of only about 1 centipoise more than the 40° C. oil viscosity of the base oil.

From the above description of the invention, those skilled in the art will perceive improvements, changes, and modifications, in the invention. Such improvements, changes, and modifications within the skill of the art are intended to be covered by the appended claims.

Having described the invention, the following is claimed:

1. A fluid power steering gear comprising:

a housing;

a power steering fluid disposed within said housing;

a seal that contains the power steering fluid within said housing; and a member that extends through said housing and said seal, said member being moveable relative to said housing and said seal in response to a change in the fluid pressure in said housing;

the power steering fluid comprising a base oil and N-(Tallowalkyl)-1,3-propanediamine dioleate, the weight percent of the N-(Tallowalkyl)-1,3-propanediamine dioleate being about 0.1% to about 5.0% by weight of the power steering fluid.

2. The power steering gear of claim 1 wherein the power steering fluid has a 40° C. oil viscosity up to about 1 centipoise greater than the 40° C. oil viscosity of the base oil.

3. The power steering gear of claim 1 wherein the base oil is selected from the-group consisting of a mineral oil, a synthetic oil, polyalkylene oxide, and blends thereof.

4. The power steering gear of claim 1 wherein the base oil is a mineral oil.

5. The power steering gear of claim 1 wherein the base oil is a blend of polyalkylene oxides.

6. The power steering gear of claim 1 wherein the power steering fluid further comprises an antioxidant.

7. The power steering gear of claim 1 wherein the antioxidant is selected from group consisting of a zinc diamyldithiocarbamate, an alkylated diphenylamine, and mixtures thereof.

8. The power steering gear of claim 1 wherein the N-(Tallowalkyl)-1,3-propanediamine dioleate comprises about 0.5% to about 1.0% by weight of the power steering fluid.

9. A fluid power steering gear comprising:

a housing a power steering fluid disposed within said housing;

a seal that contains the power steering fluid within said housing; and a member that extends through said housing and said seal, said member being movable relative to said housing and said seal in response to a change in the fluid pressure in said housing;

the power steering fluid comprising a base oil, about 0.1% to about 5.0%, by weight of the power steering fluid, N-(Tallowalkyl)-1,3-propanediamine dioleate, and an anti-oxidant.

10. The power steering gear of claim 9 wherein the base oil is selected from the group consisting of a mineral oil, a synthetic oil, polyalkylene oxide, and blends thereof.

11. The power steering gear of claim 9 wherein the base oil is a blend of polyalkylene oxides.

12. The power steering gear of claim 9 wherein the antioxidant is selected from group consisting of a zinc diamyldithiocarbamate, an alkylated diphenylamine, and mixtures thereof.

13. A fluid power steering gear comprising:

a housing a power steering fluid disposed within said housing;

a seal that contains the power steering fluid within said housing; and a member that extends through said housing and said seal, said member being movable relative to said housing and said seal in response to a change in the fluid pressure in said housing;

the power steering fluid consisting essentially of a base oil, about 0.1% to about 5.0%, by weight of the power steering fluid, N-(Tallowalkyl)-1,3-propanediamine dioleate, and an anti-oxidant.

14. The power steering gear of claim 15 wherein the power steering fluid has a 40° C. oil viscosity up to about 1 centipoise greater than the 40° C. oil viscosity of the base oil.

15. The power steering gear of claim 13 wherein the base oil is selected from the group consisting of a mineral oil, a synthetic oil, polyalkylene oxide, and blends thereof.

16. The power steering gear of claim 13 wherein the base oil is a blend of polyalkylene oxides.

17. The power steering gear of claim 13 wherein the power steering fluid further comprises an antioxidant.

18. The power steering gear of claim 17 wherein the antioxidant is selected from group consisting of a zinc Idiamyldithiocarbamate, an alkylated diphenylamine, and mixtures thereof.

* * * * *

UNITED STATES PATENT AND TRADEMARK OFFICE

CERTIFICATE OF CORRECTION

PATENT NO. : 6,503,871 B2
DATED : January 7, 2003
INVENTOR(S) : Jon W. Martin

It is certified that error appears in the above-identified patent and that said Letters Patent is hereby corrected as shown below:

Column 8,
Line 47, delete “15” and insert -- 13 --.

Signed and Sealed this

Twenty-eighth Day of October, 2003

JAMES E. ROGAN
*Director of the United States Patent and Trademark Office*